United States Patent [19]

Kimura et al.

[11] Patent Number: 4,796,411

[45] Date of Patent: Jan. 10, 1989

[54] PACKAGING FOOD IN RAISED STATE

[75] Inventors: Masatoshi Kimura; Hiroshi Okuda; Yujiro Fujikawa; Tatsuaki Inomata, all of Tsuchiura, Japan

[73] Assignee: Prima Meat Packers, Ltd. Research and Development Center, Tsuchiura, Japan

[21] Appl. No.: 48,538

[22] Filed: May 6, 1987

[30] Foreign Application Priority Data

May 6, 1986 [JP] Japan ..... 61-103397

[51] Int. Cl.[4] ..... B65B 47/00; B65B 47/10

[52] U.S. Cl. ..... 53/453; 53/471; 53/486

[58] Field of Search ..... 53/453, 559, 410, 133, 53/486, 412, 471, 478

[56] References Cited

U.S. PATENT DOCUMENTS

| | | | |
|---|---|---|---|
| 3,104,506 | 9/1963 | Rohdin | 53/453 X |
| 3,353,325 | 11/1967 | Jensen et al. | 53/453 X |
| 3,483,908 | 12/1969 | Donovan | 206/526 X |
| 3,492,773 | 2/1970 | Bergstrom | 53/453 X |
| 3,521,422 | 7/1970 | Tabor | 53/453 X |

*Primary Examiner*—Horace M. Culver
*Attorney, Agent, or Firm*—Browdy and Neimark

[57] ABSTRACT

A method of packaging food in raised state, comprising the steps of forming a displaceable wall portion integrally with and in the central section of a bottom wall of a food container so that the wall portion can be projected into and out of the container when the wall portion is pressed inward and outward, inserting a food in the container with the wall portion kept projecting outward, sealing the container with a film, and pressing the wall portion so as to be projected into the container and thereby raise the food above the plane of the upper end of the container against the tension of the film. Since the food is placed in the container with the displaceable wall portion kept projecting outward, the falling of the food during the food packing operation can be prevented. When the displaceable wall portion of the food-packed and sealed container is pressed inward to raise the food, a recess occurs in the lower surface of the container, which recess enables the container to be piled stably on the raised surface of another similar food-packed container.

3 Claims, 2 Drawing Sheets

PACKAGING FOOD IN RAISED STATE

BACKGROUND OF THE INVENTION

1. Field of the Invention

This invention relates to a method of packaging food in raised state by placing any one of various kinds of foods of comparatively small sizes in a container so that the food is heaped up in the container to a level above the plane of the upper end thereof so as to make the food appear voluminous, and covering the upper surface of the heaped with a soft film of a synthetic resin.

2. Description of the Prior Art

In a conventional regularly-used method of packaging food in raised state, the upper surface of a food placed in a container so that the food is heaped up therein to a level above the opening of the container is covered with a film. Therefore, it is necessary that the film be applied to the surface of the heaped food carefully so as to prevent the food from dropping. This necessarily causes the packaging operation to become troublesome, and the operation efficiency to decrease.

SUMMARY OF THE INVENTION

An object of the present invention is to provide a food packaging method capable of preventing the falling of the heaped food being packaged in a container, which occurs in a convention method of this kind to make it possible to carry out a heaped food packaging operation with high efficiency, the method consisting of the steps of placing food in a container so that the food does not project from the plane of the upper end of the container, sealing the opening of the container with a film, and pressing up a food-raising projecting wall, which is provided at the bottom of the container, with the container kept sealed, to thereby raise the food in the container above the opening thereof against the tension of the film.

When the packages in which the food is packed in raised state by a conventional method of this kind are piled up for being transported, they become unstable because the food projects upward from the openings of the containers.

According to the present invention, the packages can be piled up stably by utilizing the projecting wall, which is provided so as to raise the packed food, of each of the containers.

BRIEF DESCRIPTION OF THE DRAWINGS

The above and other objects as well as advantageous features of the invention will become apparent from the following description of the preferred embodiments taken in conjunction with the accompanying drawings, in which.

DESCRIPTION OF THE PREFERRED EMBODIMENT

Figure 1:
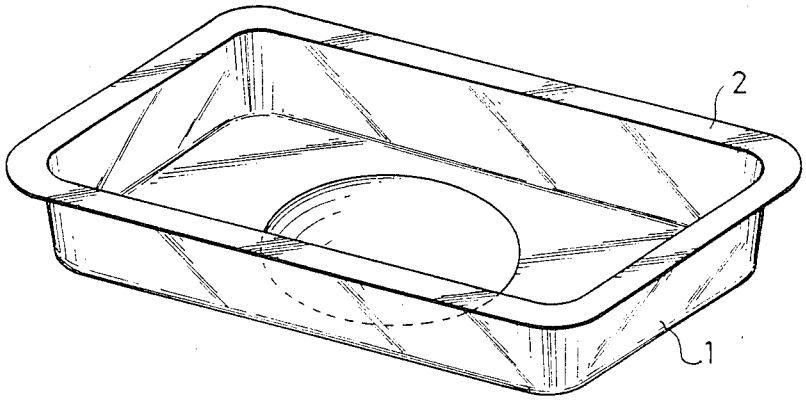
FIG. 1 is a perspective view of a container.

A container 1 is formed to a comparatively small depth, and has an outwardly-extending flange 2 at the circumference of an opening at the upper end thereof. The container 1 is made of a thin, untreated plate of a synthetic resin, such as vinyl chloride.

A bottom wall 3 of the container 1 is provided at its central portion with a projecting wall portion 4 which can be displaced toward the interior of the container 1 and the outside of the lower surface of the bottom wall 3 when the wall portion 4 is pressed by a finger inward and outward, and which is formed integrally with the bottom wall 3 via a bending line 5.

This projecting wall portion 4 is circular in plan and arcuate in cross section. First, a predetermined member of pieces of a food A are inserted from the opening into the container 1, which is formed as mentioned above, with the wall portion 4 projecting toward the outside of the lower surface of the bottom wall 3, in such a manner that the upper surface of the food A is substantially in agreement with the plane of the upper end of the container 1, i.e., does not project from the same plane. The food A in this embodiment consists of short rod type sausages.

After the food A has been packed in the container 1, the opening of the container 1 is sealed with a soft film 6 of a synthetic resin. The film-sealing operation is carried out by heat-sealing the peripheral portion of the film 6 to the flange 2 provided at the circumference of the upper end of the container 1.

Figure 3:
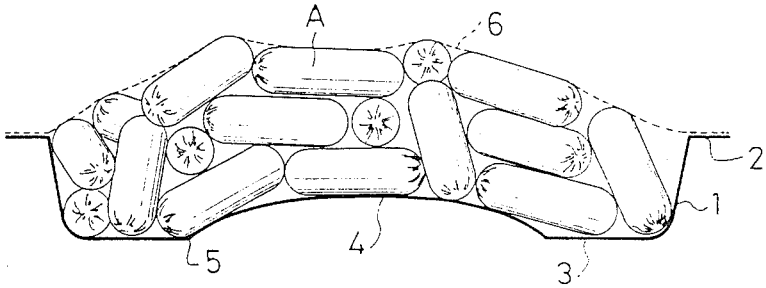
FIG. 3 is a sectional view of the container of FIG. 2 with the food in raised state.

With the food thus held in the container, the projecting wall portion 4 is pressed upward to project it into the container 1 as shown in FIG. 3. Due to the wall portion 4 thus projecting inwardly, the food in the container is raised above the plane of the upper end of the container 1 against the tension of the film 6 with which the food is covered. Consequently, a package of a food in a raised state is obtained.

The film 6 used in this embodiment is formed of a gas-impermeable synthetic resin. Accordingly, the film 6 serves as a very effective barrier with respect to the gas in the container, so that the oxidation and fading of the content of the container can naturally be prevented.

In the method of packaging food in raised state according to the present invention described above, the projecting wall portion provided in the bottom wall of a container is set projected to the outside of the lower surface of the bottom wall, and a food is then inserted into the container so that the food does not project beyond the plane of the upper opened end of the container, the opening of the container being thereafter sealed with a film. After the container has been sealed, the projecting wall portion is pressed upward into the container, so that the food can naturally be raised against the tension of the film. This can completely prevent the falling of the heaped food in a container during the packaging of the container, which occurs in a conventional method of this kind. Therefore, the packaging of food in a raised state can be done very easily, and an operation for packaging such a food can be carried out very efficiently, these constituting the great characteristics of the present invention.

Figure 2:
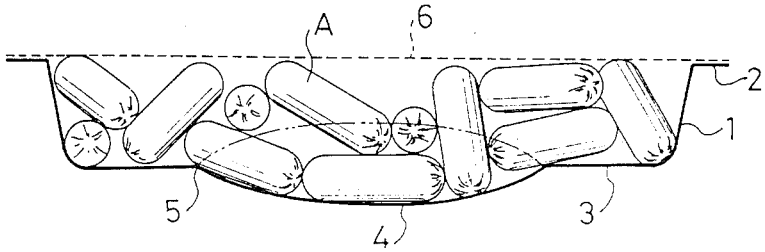
FIG. 2 is a sectional view of the container holding a food therein, heat-sealed at the opening thereof with a soft film of a synthetic resin and not yet subjected to a food-raising step.
Figure 4:
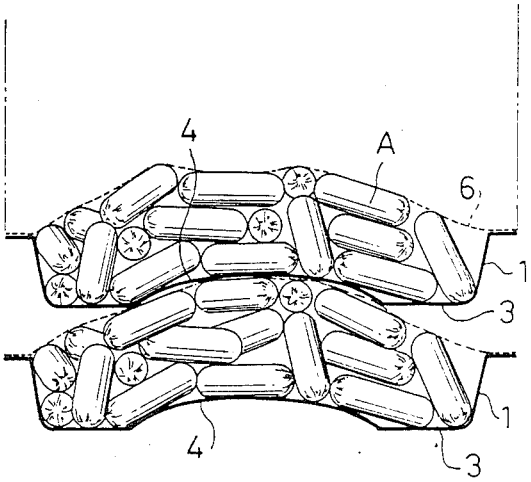
FIG. 4 illustrates containers piled up with the food therein raised.
Figure 5:
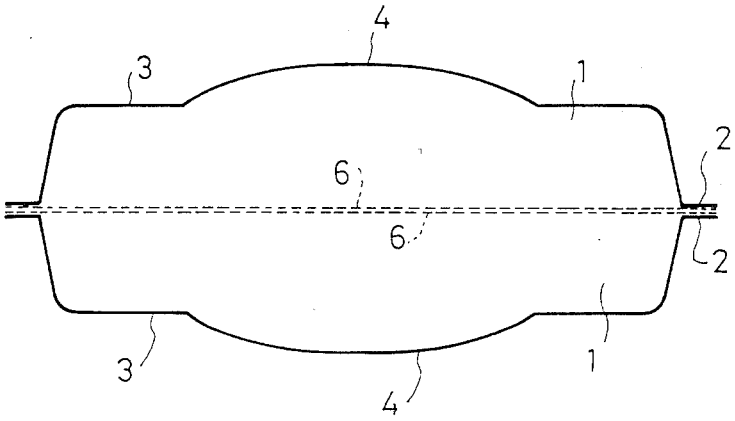
FIG. 5 illustrates containers piled with their open ends contacting each other, in which the raisable bottom walls thereof have not yet been pressed.

In order to transport the packages, which are obtained by the above-described method, they can be piled one on top of another stably by engaging the recess, which occurs naturally when the projecting wall portion is pressed upward, of an upper package with the raised food portion of a lower package as shown in FIG. 4. In another package-piling mode, the packages, the projecting wall portions of which are not yet subjected to a food-raising step, i.e., in the condition shown in FIG. 2, are piled as the opening side of the packages are engaged with each other as shown in FIG. 5. This enables the packages to be piled stably without projecting the food outward. Accordingly, the packages can be transported without damaging the food.

Even the food in the packages in the food-raised state shown in FIG. 3 can be drawn back to the level not higher than the plane of the upper end of each of the containers by projecting the displaceable wall portions thereof to the outside of the lower surfaces of the bottom walls thereof, i.e., the packages can be returned to the condition shown in FIG. 2. Consequently, such packages can be piled with the opening sides thereof engaged with each other as shown in FIG. 5. Therefore, the present invention can be very much conveniently used.

The food to which the method according to the present invention is applied is not limited to the food referred to in the above embodiment. This method can, of course, be applied to small-sized fruits, for example, strawberries and cherries.

The present invention is not, of course, limited to the above embodiment; it may be modified in various ways within the scope of the appended claims.

What is claimed is:

1. A method of packaging of pieces of food in a raised state, comprising the steps of:

forming a projecting wall portion integrally with and in the central section of a bottom wall of container, said wall portion projecting towards the outside of the lower surface of said bottom wall;

inserting the pieces of food in said container with said wall portion maintained so as to project towards the outside of the lower surface of said bottom wall;

sealing the opening of said container with a film; and applying pressure on the outside surface of said wall portion of said sealed container so that said wall portion is pressed upwardly, said wall portion projecting into said container forming a recess on an underside surface of the package, thereby raising the pieces of food by the food-raising force of said inwardly-projected wall portion to a level above the plane of the upper end of said container against the tension of said film to form a bulge extending above the plane of the upper end of said container.

2. The method according to claim 1, wherein the pieces of food comprises a type of food selected from the group of rod-shaped sausages, cherries, and strawberries.

3. The method according to claim 1 comprising the steps of forming a plurality of food packages and stacking said packages such that the bulge of a first package in the stack fits into the recess of a second package of the stack so that the stack of packages is stable.

* * * * *